US012275546B2

(12) United States Patent
Ruers et al.

(10) Patent No.: US 12,275,546 B2
(45) Date of Patent: Apr. 15, 2025

(54) HIGH SPEED FILLING OF A TRAY

(71) Applicant: The Procter & Gamble Company, Cincinnati, OH (US)

(72) Inventors: Henri Theo Leonie Ruers, Antwerp (BE); Andrea Ziantoni Liberatori, La Hulpe (BE)

(73) Assignee: The Procter & Gamble Company, Cincinnati, OH (US)

( * ) Notice: Subject to any disclaimer, the term of this patent is extended or adjusted under 35 U.S.C. 154(b) by 226 days.

(21) Appl. No.: 18/107,686

(22) Filed: Feb. 9, 2023

(65) Prior Publication Data

US 2023/0257145 A1 Aug. 17, 2023

Related U.S. Application Data

(60) Provisional application No. 63/309,270, filed on Feb. 11, 2022.

(51) Int. Cl.

| | |
|---|---|
| ***B65B 35/40*** | (2006.01) |
| ***B65B 1/06*** | (2006.01) |
| ***B65B 7/28*** | (2006.01) |

(52) U.S. Cl.

CPC ..... *B65B 35/40* (2013.01); *B65B 1/06* (2013.01); *B65B 7/2842* (2013.01)

(58) Field of Classification Search

CPC ..... B65B 1/06; B65B 35/40; B65B 39/14; B65B 43/52; B65B 5/068; B65B 57/06; B65B 35/30; B65B 35/32; B65B 1/04

See application file for complete search history.

(56) References Cited

U.S. PATENT DOCUMENTS

| | | | | |
|---|---|---|---|---|
| 4,420,924 | A * | 12/1983 | Hoyrup | B65B 7/2807 53/307 |
| 9,783,335 | B2 | 10/2017 | Everett | |
| 9,881,788 | B2 | 1/2018 | Kim et al. | |
| 10,017,291 | B2 | 7/2018 | Smith et al. | |
| 10,934,072 | B2 | 3/2021 | Lantz et al. | |
| 11,794,947 | B2 | 10/2023 | Hoefte et al. | |
| 11,851,232 | B2 | 12/2023 | Leonie | |

(Continued)

FOREIGN PATENT DOCUMENTS

| | | | | |
|---|---|---|---|---|
| EP | 2251266 | A1 * | 11/2010 | B65B 43/44 |
| EP | 3587293 | A1 | 1/2020 | |

(Continued)

OTHER PUBLICATIONS

Unpublished U.S. Appl. No. 18/506,351, filed Nov. 10, 2023, Henri Theo Leonie Ruers et al.

(Continued)

*Primary Examiner* — Anna K Kinsaul
*Assistant Examiner* — Himchan Song
(74) *Attorney, Agent, or Firm* — Andrew J. Mueller

(57) ABSTRACT

A process for packaging a product. The product is dispensed into a tray by a dispensing system while the tray is moving beneath the dispensing system. The dispensing system includes a hopper that releases products that are funneled in the tray. The dispensing system includes two legs that each rotate about a respective pivot that constrain the product as the product is transported from the hopper into the tray.

20 Claims, 6 Drawing Sheets

(56) References Cited

U.S. PATENT DOCUMENTS

| | | | | |
|---|---|---|---|---|
| 2005/0132670 | A1* | 6/2005 | Curran | B65B 9/08 53/469 |
| 2014/0299227 | A1* | 10/2014 | Dix | B65B 39/12 141/11 |
| 2016/0001909 | A1* | 1/2016 | Schütte | B65B 51/146 53/134.1 |
| 2018/0257827 | A1 | 9/2018 | Drosos et al. | |
| 2019/0062023 | A1 | 2/2019 | Lantz et al. | |
| 2019/0080790 | A1* | 3/2019 | Patel | B65B 35/32 |
| 2020/0062429 | A1* | 2/2020 | Felling | B65B 39/14 |
| 2021/0047072 | A1 | 2/2021 | Ng Pak Leung et al. | |
| 2022/0081155 | A1 | 3/2022 | Hoefte et al. | |
| 2022/0185534 | A1 | 6/2022 | Hoefte et al. | |
| 2022/0289436 | A1 | 9/2022 | Hoefte et al. | |
| 2022/0380086 | A1 | 12/2022 | Hoefte et al. | |
| 2023/0103439 | A1 | 4/2023 | Hoefte et al. | |
| 2023/0110630 | A1 | 4/2023 | Hoefte et al. | |
| 2023/0132541 | A1 | 5/2023 | Hoefte et al. | |
| 2023/0227186 | A1* | 7/2023 | Ruers | B65B 7/01 53/420 |
| 2023/0257141 | A1* | 8/2023 | Ruers | B65B 7/2842 53/485 |
| 2023/0264852 | A1 | 8/2023 | Hoefte et al. | |
| 2023/0264853 | A1 | 8/2023 | Hoefte et al. | |
| 2023/0286695 | A1 | 9/2023 | Hoefte et al. | |
| 2023/0322455 | A1 | 10/2023 | Beelen et al. | |
| 2023/0331447 | A1 | 10/2023 | Hoefte et al. | |
| 2024/0002100 | A1 | 1/2024 | Hoefte et al. | |

FOREIGN PATENT DOCUMENTS

| | | | |
|---|---|---|---|
| EP | 3753856 | A1 | 12/2020 |
| EP | 3882164 | A1 | 9/2021 |
| JP | 4536881 | B2 | 6/2010 |
| WO | 2018022493 | A1 | 2/2018 |

OTHER PUBLICATIONS

16227 Extended European Search Report and Search Opinion for 23155728.1 dated Aug. 14, 2023, 07 pages.

* cited by examiner

HIGH SPEED FILLING OF A TRAY

FIELD OF THE INVENTION

Process for high speed filling of a tray.

BACKGROUND OF THE INVENTION

The speed of container filling lines can be limited by the slowest operation that occurs on the line. To maximize the efficiency of capital expended on production, managers seek to increase the speed of manufacturing lines as much as possible.

A variety of systems are employed on container filling lines to increase the number of containers that can be filled per unit of time. Rotary dispensing systems, in which both the filler and the container are transported on a circumferential path while the container is filled, are common. Another common dispensing system is a shuttle dispensing system in which the filler shuttles back and forth and in which the filler travels with the container for a short distance as the container is filled. Once filling is complete, the filler quickly shuttles upstream to fill another container passing there beneath. A single shuttle can have multiple fillers in one or both of the machine direction and cross direction so that multiple containers may be filled for each shuttle cycle.

Rotary dispensing systems tend to require a significant quantity of floor space compared to the footprint of the individual containers that are filled. Shuttle dispensing systems require complex machinery and controls to shuttle the filler back and forth. As the number of containers filled per unit of time increases, the momentum of the filler in a shuttle system must be managed carefully so as to avoid vibration and or damage to equipment.

For water soluble unit dose products, such as laundry and dish products, individual product can have a maximum dimension of about 5 cm. Thus, rotary dispensing systems that are designed to place many water soluble unit dose products into single containers may require a large amount of floor space. Shuttle dispensing of a large quantity of water soluble unit dose products into a single container may be complicated by the large mass of water soluble unit dose products that must be shuttled.

With these limitations in mind, there is a continuing unaddressed need for a process for high speed dispensing of water soluble unit dose products that is space efficient and simple to control and operate.

SUMMARY OF THE INVENTION

A process for packaging a product comprising the steps of: manufacturing the product, wherein said product is a substrate treatment composition; providing a tray carriage system; providing a tray movable in or on said tray carriage system, optionally wherein said tray carriage system comprises a plurality of linear motor vehicles; moving said tray via said tray carriage system in a machine direction; providing a dispensing system above said tray carriage system; dispensing said product into said tray via said dispensing system; wherein said dispensing system comprises: a product hopper having a downstream end and an upstream end, wherein said hopper has a closed position and an open position; a downstream leg having a downstream leg pivot portion and a downstream leg distal end, wherein said downstream leg pivot portion is rotatable about a downstream leg pivot nearer to said downstream end than said upstream end; a downstream leg driver engaged with said downstream leg; an upstream leg having an upstream leg pivot portion and an upstream leg distal end, wherein said upstream leg pivot portion is rotatable about an upstream leg pivot nearer to said upstream end than said downstream end; an upstream leg driver engaged with said upstream leg; providing a hood engagement system above said tray carriage system and downstream of said dispensing system; providing a hood moveable in said hood engagement system; engaging said hood with said tray via said hood engagement system to close said tray to form a closed package; and shipping said closed package.

DETAILED DESCRIPTION OF THE INVENTION

A high speed process for dispensing products into a tray is described herein. The process can be a part of an end to end process for packaging a product. The product can be any product of the type that can be shipped in a paperboard or corrugate package comprising a tray and a hood telescopically fitted to one another. The product can be a substrate treatment composition. The product can be a substrate treatment composition selected from a laundry treatment composition, a hard surface treatment composition, a laundry washing machine treatment composition, a hair treatment composition, a skin treatment composition, an oral care composition, a cosmetic composition, a nail treatment composition, an air treatment composition, a dish treatment composition, a disposable absorbent article, and a topical or ingested health care composition. The substrate treatment composition can comprise an ingredient selected from a surfactant, a bleach, a fabric softener, and combinations thereof.

Figure 1:
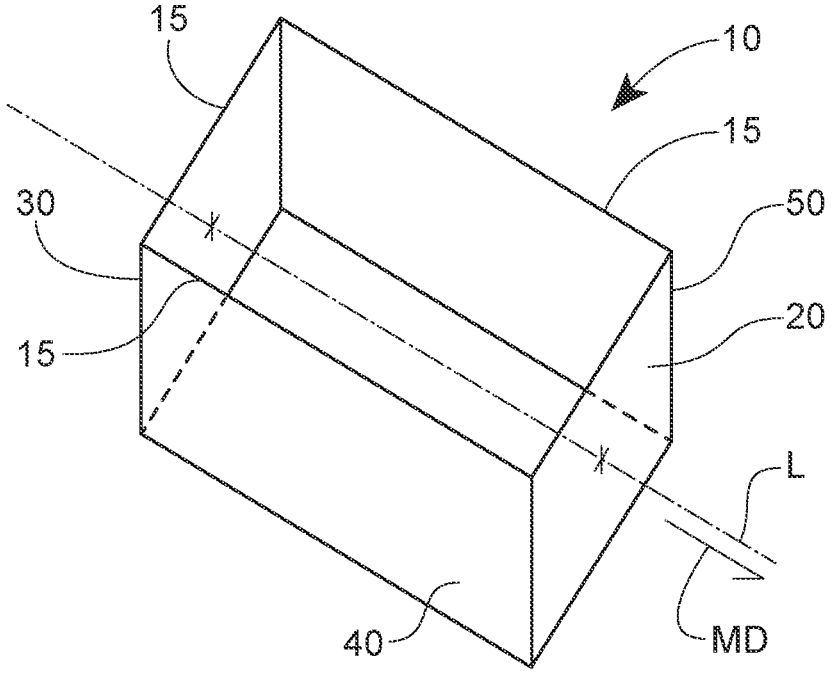
FIG. 1 is a tray.

A tray 10 employed in the process is shown in FIG. 1. The tray 10 and hood can be formed of paperboard or corrugate. Paperboard and corrugate materials can comprise pulp. The paperboard or corrugate can have a thickness from 1 mm to about 3 mm. The paperboard or corrugate can be a laminate. The paperboard or corrugate can comprise pulp. The paperboard or corrugate can comprise colorants, preservatives, plasticizers, ultraviolet stabilizers, oxygen, perfume, recycled materials, moisture barriers, and combinations thereof. Corrugate can comprise a laminate of two sheets of paperboard having a fluted layer disposed between the two sheets of paperboard. Each of the tray 10 and hood can be a single piece of die cut paperboard or corrugate having a pattern of the faces of the tray 10 or hood and flaps extending from the faces or panels. The tray 10 or hood can be erected by joining a combination of the flaps or a combination of the flaps and faces or panels to erect the tray 10 or hood. The flaps and or faces or panels can be joined to one another by gluing, thermal bonding, fitting tabs to slots, and engaging interlocking structures.

The tray 10 can be conveyed in a machine direction MD. The tray 10 can comprise a leading face 20 and a trailing face 30 upstream of the leading face. The tray 10 can have a front face 40 and a back face 50 opposite the front face 40. The front face 40 and the back face 50 extend from the leading face 20 to the trailing face 30 in the machine direction MD. The tray 10 can comprise a peripheral rim 15 defining a top opening of the tray 10. The tray 10 can have a longitudinal axis L in line with the machine direction MD.

Figure 2:
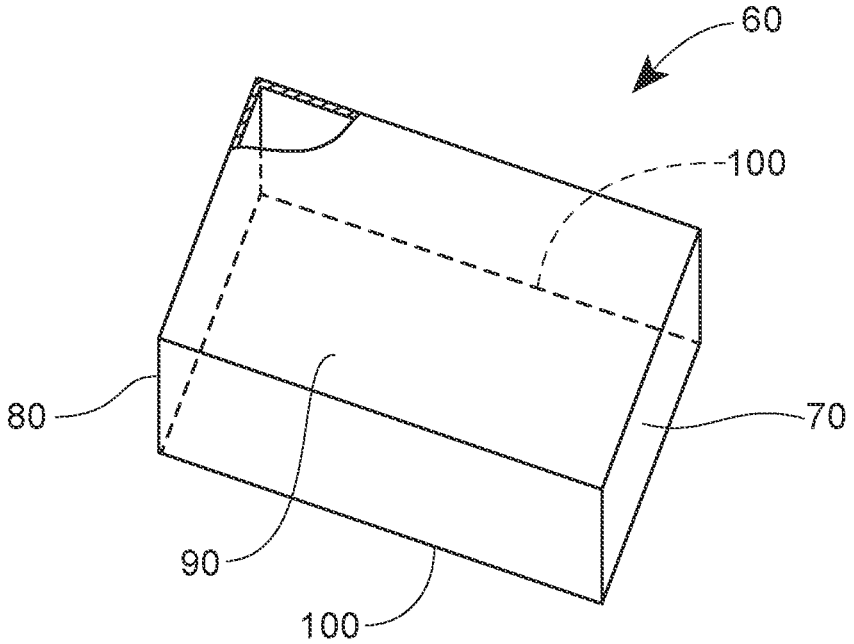
FIG. 2 is a hood.
Figure 3:
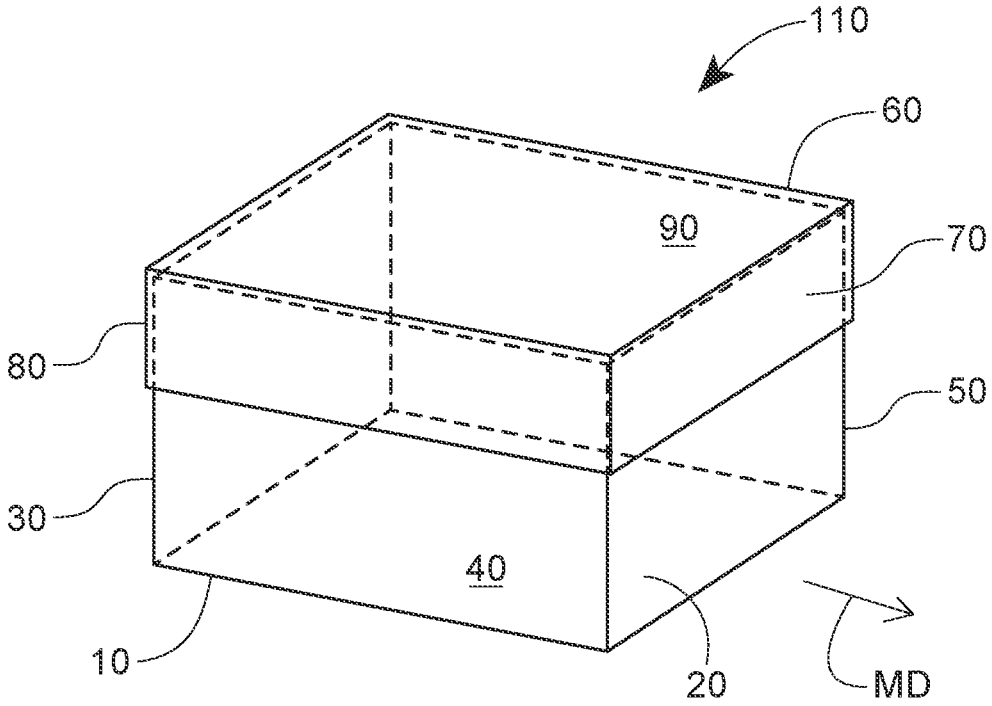
FIG. 3 is a tray having a hood fitted thereto.

A hood 60 employed in the process is shown in FIG. 2. The hood 60 can be formed of paperboard or corrugate. The hood 60 can comprise a leading panel 70, trailing panel 80 opposite to and upstream of the leading panel 70, and a hood top 90 extending from the leading panel 70 to the trailing panel 80. The hood 60 can comprise a pair of opposing hood side peripheral edges 100. The hood 60 can be telescopically fitted to the tray 10 to form a closed package 110 (FIG. 3). If the hood 60 is fabricated of corrugate, the flutes can be aligned or substantially aligned with the fold lines between the hood top 90 and the leading panel 70 and the hood top 90 and the trailing panel 70. Such an arrangement can provide for a sharp fold line between the hood top 90 and the leading panel 70 and the trailing panel 70.

Figure 4:
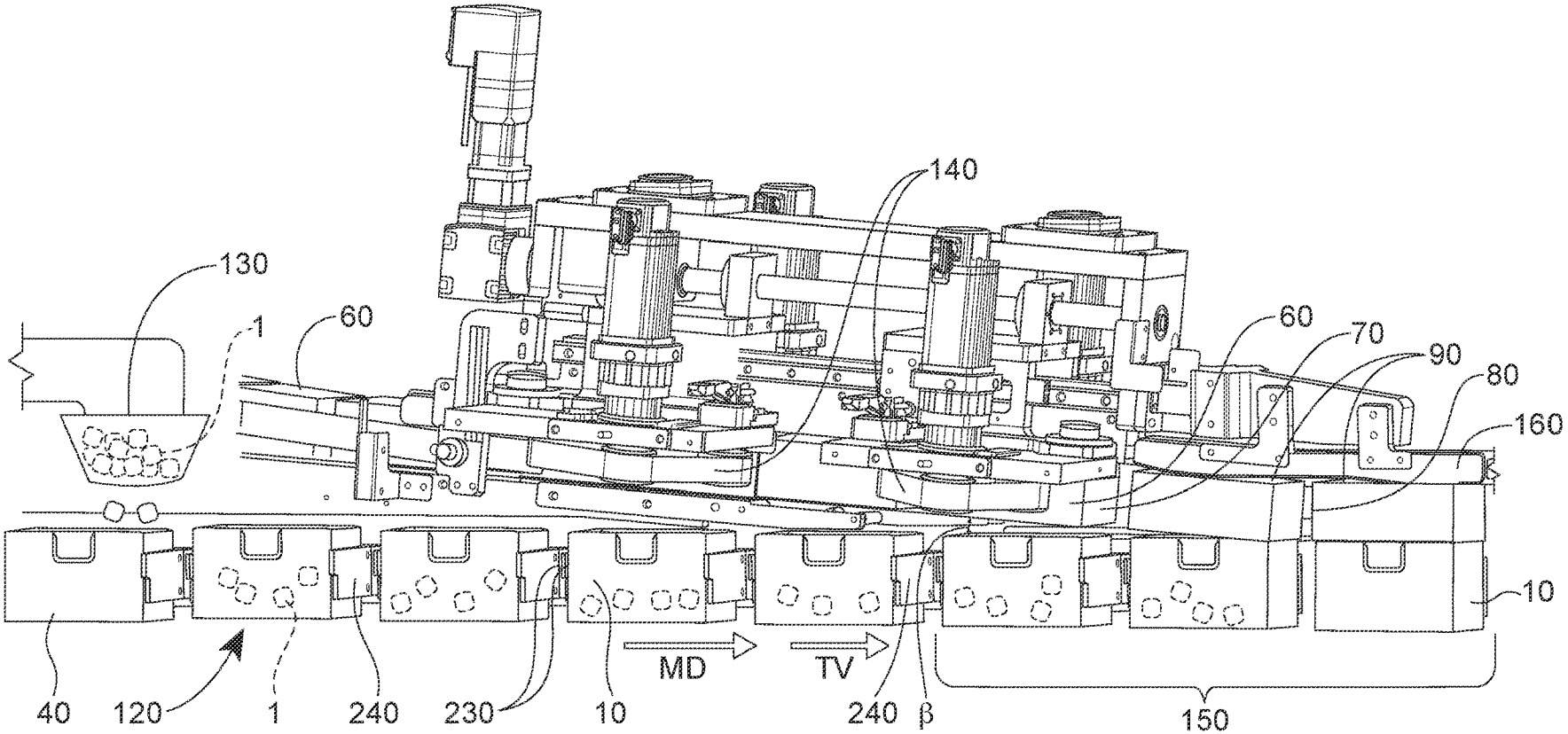
FIG. 4 is a packaging line for dispensing products into a tray and fitting a hood to the tray to close the package.

The high speed process for dispensing a product 1 into a tray 10 described herein can be part of an end to end process for packaging a product 1, as shown in FIG. 4. The steps of the process can include manufacturing the product 1. The product 1 can be a substrate treatment composition. A tray carriage system 120 can be provided. The tray 10 can be provided and be movable in or on the tray carriage system 120. The tray 10 can be moved at the tray velocity TV via the tray carriage system 120 in the machine direction MD. The tray velocity TV can be constant or variable.

A dispensing system 130 can be provided and the product 1 can be dispensed into the tray via the dispensing system 130. The product 1 can be a water soluble unit dose laundry or dish cleaning product. The product 1 can be TIDE PODS, ARIEL 3 IN 1 PODS, FAIRY ALL IN ONE, CASCADE ACTION PACKS, CASCADE PLATINUM, and the like available from The Procter & Gamble Company.

A hood engagement system 140 can be provided above the tray carriage system 120 and downstream of the dispensing system 130. The hood 60, which has a leading panel 70 and a trailing panel 80 opposite to and upstream of the leading panel 70 can be oriented at an angle β, which is from about 0.5 degrees to about 20 degrees, optionally from about 2 degrees to about 15 degrees, optionally from about 5 degrees to about 10 degrees, relative to the machine direction. The hood 60 is engaged with the tray 10 via the hood engagement system 140 to close the tray 10 to form the closed package 110.

The leading panel 70 can be first engaged with the tray 10 at a merging location 150 along the tray carriage system 120. The hood engagement system 140 can further comprise a hood guide 160 above the tray carriage system 120 at or downstream of the merging location 150. The hood guide 160 can be nearer to the tray carriage system 120 downstream of the merging location 150 than at the merging location 150. The hood guide 160 can contact the hood top 90 to telescopically fit the hood 60 onto the tray 10. The hood guide 160 can be a wedge that pushes the hood 60 to fit to the tray 10. The hood guide 160 can be a belt that is positioned at a small angle relative to the machine direction MD to force the hood 60 to fit to the tray.

After the hood 60 is fitted to the tray 10, the closed package 110 can be shipped. For example the closed package 110 can be shipped to a distributor or distribution facility and further along the supply chain until it reaches a location at which a user can open the package 110 by removing the hood 60, retrieve the product 1 from the tray 10, and use the product 1.

Figure 5:
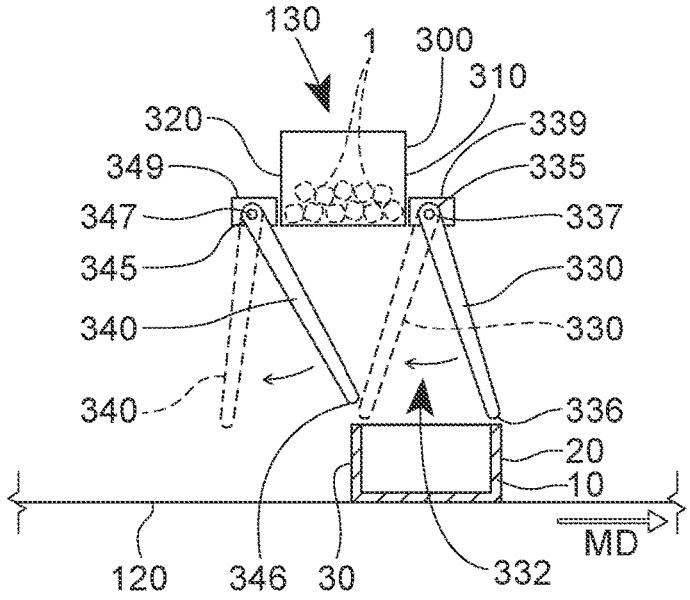
FIG. 5 is a side view of dispensing system.

A dispensing system 130 is shown in FIG. 5. The dispensing system 130 can comprise a product hopper 300 that is positioned above the tray carriage system 120. The hopper 300 holds a quantity of products 1 that are to be dispensed into the tray 10. For example, if the package 110 is supposed to contain ten products 1, then the hopper 300 holds ten products 1 to be dispensed into the tray 10. A system can be provided upstream of the hopper 300 or be integrated with the hopper 300 that counts the number or weight of products dispensed into the hopper 300. The weighing system can be a multi-head rotary weigher. A suitable weighing system can be a CCW-RV weighing system available from ISHIDA, Kyoto, Japan (https://www.ishida.com/ww/en/). Opening and closing of the hopper 300 can be controlled by a controller that receives information on the position of the tray 10 and appropriate weight, count, or volume of product contained in the hopper 300. The controller can generate an activation signal to open the hopper 300 when all logic conditions are met. The controller can then direct that the hopper 300 be refilled with an appropriate weight, count, or volume of product to be dispensed the next time the hopper 300 is opened.

The hopper 300 can have a downstream end 310 and an upstream end 320. The downstream end 310 is oriented in the direction in which the trays 10 move, which is the machine direction MD, and the upstream end 320 is opposite the downstream end 310. The hopper 300 can have a closed position in which the hopper 300 retains the products 1 and an open position in which the products 1 are released from the hopper to fall into the tray 10. After the products 1 fall away from the hopper 300, the hopper 300 can close and be refilled with the desired quantity of products 1 so as to be ready to dispense the products 1 into another tray 10 that is subsequently positioned under the dispensing system 130. The hopper 300 can be a clam shell hopper 300. The hopper 300 when in a fully open position can have an opening width in the cross direction that substantially matches the tray width 370, or is optionally less than about 95%, optionally less than 85%, optionally less than 75%, of the tray width 370.

Part of the dispensing system 130 can function as a swinging funnel that can guide the products 1 towards the tray 10 as the tray 10 moves beneath the dispensing system 130. The tray carriage system 120 can move the trays 10 in the machine direction MD. Since the trays 10 move along a linear path, the swinging funnel 332 needs to principally guide the falling products 1 in the downstream and upstream directions.

The dispensing system 130 can comprise a downstream leg 330 and upstream leg 340. The downstream leg 330 and the upstream leg 340 can present flat or generally flat surfaces in the cross direction. Optionally, they may have a curved shapes in the cross direction the concave sides of which are oriented towards one another to form a funnel shape. A curved shape in the cross direction can help to constrain flow of product in the cross direction. The legs can be fabricated from a plastic or metal material and can have a smooth surface on the parts constituting the interior of the funnel. The downstream leg 330 and upstream leg 340 can swing in the machine direction MD and counter to the machine direction MD, that is downstream and upstream, respectively. As the tray 10 moves beneath the dispensing system 130, the downstream leg 330 and upstream leg 340 funnel the products 1 into the tray 10. To provide for swinging of the downstream leg 330, the downstream leg 330 can have a downstream leg pivot portion 335 and a downstream leg distal end 336. The downstream leg distal end 336 is opposite the downstream leg pivot portion 335. The downstream leg pivot portion 335 can be rotatable about a downstream leg pivot 337. The downstream leg pivot 337 can be nearer to the downstream end 310 of the hopper 300 than the upstream end 320 of the hopper 300.

Similarly, the upstream leg 340 can have an upstream leg pivot portion 345 and an upstream leg distal end 346. The upstream leg distal end 346 is opposite the upstream leg pivot portion 345. The upstream leg pivot portion 345 can be rotatable about an upstream leg pivot 347. The upstream leg pivot 347 can be nearer to the upstream end 320 of the hopper 300 than the downstream end 310 of the hopper 300.

A downstream leg driver 339 can be engaged with the downstream leg 330 to provide for reciprocating swinging of the downstream leg 330. Likewise an upstream leg driver 349 can be engaged with the upstream leg 340 to provide for reciprocating swinging of the upstream leg 340. The downstream leg driver 339 and upstream leg driver 349 can each be an electric motor. Optionally, downstream leg driver 339 and the upstream leg driver 349 can each be a linkage to which an electric motor is engaged. The linkage can link movement of the downstream leg 330 and the upstream leg 340 so that a single motor can drive both legs. Optionally, a single motor can drive a linkage that is engaged with both the downstream leg 330 and the upstream leg 340. Optionally, a single motor can be engaged with both the downstream leg driver 339 and the upstream leg driver 349 by way of a belt, chain, or gear system. The downstream leg driver 339 and the upstream leg driver 349 can have separate motors. The downstream leg driver 339 can be a motor engaged with an axle that is engaged with the downstream leg pivot portion 335. Likewise, the upstream leg driver 349 can be a motor engaged with an axle that is engaged with the upstream leg pivot portion 345. The motor or motors can rotationally reciprocate to swing the downstream leg 330 and the upstream leg 340 back and forth. The mechanism or mechanisms chosen to swing the downstream leg 330 and upstream leg 340 can provide for a reciprocating swinging motion for the downstream leg 330 and the upstream leg 340.

The motion profile for the downstream leg 330 and the upstream leg 340 can be programmed so that at all positions in operation, the downstream leg distal end 336 and the upstream leg distal end 346 are nearer to one another than the downstream leg pivot portion 335 and the upstream leg pivot portion 345. By maintaining such positioning, the downstream leg 330 and the upstream leg 340 form a funnel 332 along the machine direction MD that help to direct or channel the products 1 from the hopper 300 into the tray 10.

In operation, while the product 1 is transported from the hopper 300 into the tray 10 the downstream leg distal end 336 can be moved in concert with the leading face 20 of the tray 10 and the upstream leg distal end 346 can be moved in concert with the trailing face 30 of the tray 10. As the tray 10 moves beneath the hopper 300, the distal ends of the legs move in concert with the faces of the tray 10 so that the downstream leg 330 and the upstream leg 340 can funnel towards one another as the product 1 is transported from the hopper 300 to the tray 10. Moreover, as the tray 10 moves beneath the dispensing system, the funneling of the downstream leg 330 and the upstream leg 340 can track movement of the tray 10. In effect, together the downstream leg 330 and the upstream leg 340 can form a funnel 332 that swings in concert with the tray 10 passing beneath the dispensing system 130.

Each reciprocation of the funnel 332 can track a tray 10 that moves beneath the dispensing system 130. After the products 1 are dispensed into the tray 10, the downstream leg 330 and the upstream leg 340 can return upstream to align with the next tray 10 arriving to the dispensing system 130. The downstream leg 330 and the upstream leg 340 can reciprocate in the machine direction MD and a direction opposite the machine direction MD. The downstream leg 330 can swing in reciprocating motion partially about the downstream leg pivot 337. The upstream leg 340 can swing in reciprocating motion partially about the upstream leg pivot 347. Each reciprocation of the downstream leg 330 and the upstream leg 340 can guide products 1 from the hopper 300 to an individual tray 10 as the trays 10 move in the machine direction MD beneath the dispensing system 130. The amount of time available for products 1 to be dispensed into the tray 10 can be extended by operating the downstream leg 340 so that the downstream leg distal end 336 is upstream of the downstream leg pivot 337 when the product hopper 300 is opened to commence dispensing of the product 1 from the product hopper 300 to the tray 10. In such an arrangement, the funnel 332 is directed upstream when the product hopper 300 is opened. As the tray 10 moves beneath the dispensing system 130, the downstream leg distal end 336 can move in concert with and just upstream of the leading face 20. Likewise, the upstream leg distal end 346 can move in concert with and just downstream of the trailing face 30 as the tray 10 moves beneath the dispensing system 130. The funnel 332 comprised of the downstream leg 330 and the upstream leg 340 can be directed in the upstream direction, which is opposite the machine direction MD, when the hopper 300 is opened to commence dispensing the of the product 1 into a tray 10. As the products 1 fall between the downstream leg 330 and the upstream leg 340, which together form a funnel 332, the downstream leg 330 can track the movement of and be just upstream of the leading face 20 and the upstream leg 340 can track the movement of and be just downstream of the trailing face 30.

Figure 6:
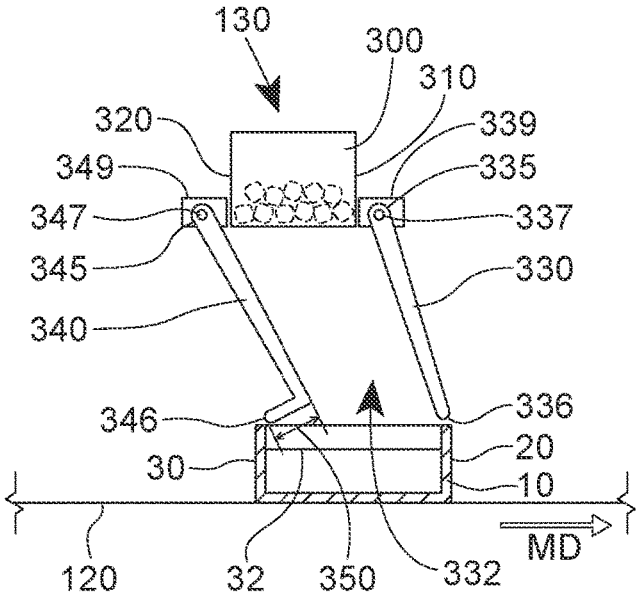
FIG. 6 is a side view of a dispensing system.

Depending on the depth of the tray 10 and the mechanical properties of the products 1 being dispensed, and the velocity at which the products 1 enter the tray 10, there may be the potential for some of the products 1 to bounce upon hitting the fill level of the tray. That could lead to products 1 being spilled from the tray 10 since the tray 10 is in continuous motion in the machine direction MD during filling. That concern may be particularly acute in the upstream direction at the trailing face 30. To help limit the potential of products 10 bouncing out of the tray in the upstream direction, the upstream distal 346 can comprise a foot 348 oriented opposite the machine direction MD (FIG. 6). The funnel 332 formed by the downstream leg 330 and the upstream leg 340 can also dissipate energy from the falling products 1 so that as the products 1 accumulate in the tray 10, there is less potential for products 1 to bounce out of the tray 10. The angled downstream leg 330 and upstream leg 340 can absorb some of the energy of the falling products 1 and transmit that energy to a frame supporting the dispensing system 130.

The foot 348 acts as a barrier to products 1 bouncing out of the tray in the upstream direction. In effect the upstream portion of the funnel formed by the downstream leg 330 and the upstream leg 340 is structured to be more narrow than necessary so that the products 1 are guided to a portion of the interior of the tray 10 away from the trailing face 30. The tray 10 can have an interior tray length 32 which is the distance between the interior surfaces of the leading face 20 and the trailing face 30. The tray length 32 can be from about 100 mm to about 450 mm, optionally from about 150 mm to about 350 mm. The foot 348 can have a foot length 350 in the machine direction MD. The foot length 350 can be from about 5% to about 30%, optionally from about 5% to about 20%, optionally from about 5% to about 10%, of the tray length 32. The foot length 350 is measured in the machine direction with the upstream leg 340 positioned so that a line connecting the upstream leg distal end 346 and the upstream pivot 347 is orthogonal to the machine direction MD. Such a foot length 350 can provide for the product 1 being positioned sufficiently far away from the trailing face 30 and act as a barrier to product 1 bouncing out over the trailing face 30 as the tray 10 moves while being filled.

Figure 7:
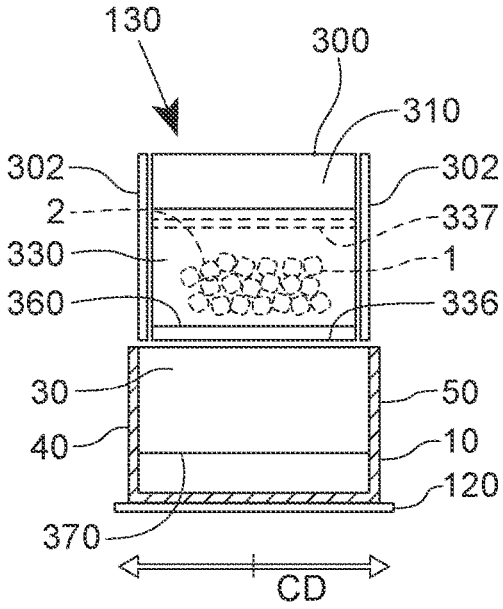
FIG. 7 is an upstream view opposite the machine direction of a dispensing system and tray.

As the products 1 fall from the hopper 300 and are guided into the tray 10 by the downstream leg 330 and the upstream leg 340, there is the potential for the wad of products 1 to change shape in flight from the hopper 300 to the tray 10. This may occur when the downstream leg 330 and the upstream leg 340 are arranged in a funnel configuration which may tend to constrict in the machine direction MD the wad of falling products 1. The constriction in the machine direction MD of the wad of products 1 may cause the products 1 to disperse in the cross direction CD, which is orthogonal to the machine direction MD. To guide a potentially broadening wad of falling products 1 the downstream leg 330 and the upstream leg 340 can be as extensive or nearly as extensive in the cross direction CD as the tray 10 (FIG. 7). Optional side shields 302 can be provided to reduce the likelihood that products 1, for example substrate treatment composition 2, will escape beyond the lateral edges of the tray 10. The optional side shields 302 can extend from upstream of the upstream end 320 of the hopper 300 to downstream of the downstream end 310 of the hopper 300. Together, the side shields 302 and downstream leg 330 and the upstream leg 340 can constrain and direct flight of the products 1 from the hopper 300 into the tray. The hopper 300 can have a hopper length in the machine direction MD which is the distance between the downstream leg pivot 337 and the upstream leg pivot 347. The side shields 302 can have a length in the machine direction that is from about 100% to about 125% of the hopper length HL. The side shields 302 can be generally aligned with the front face and the back face 50 in the machine direction MD. The side shields 302 can be parallel to the machine direction MD. The hopper length in the machine direction MD can be from about 100 mm to about 400 mm.

Figure 8:
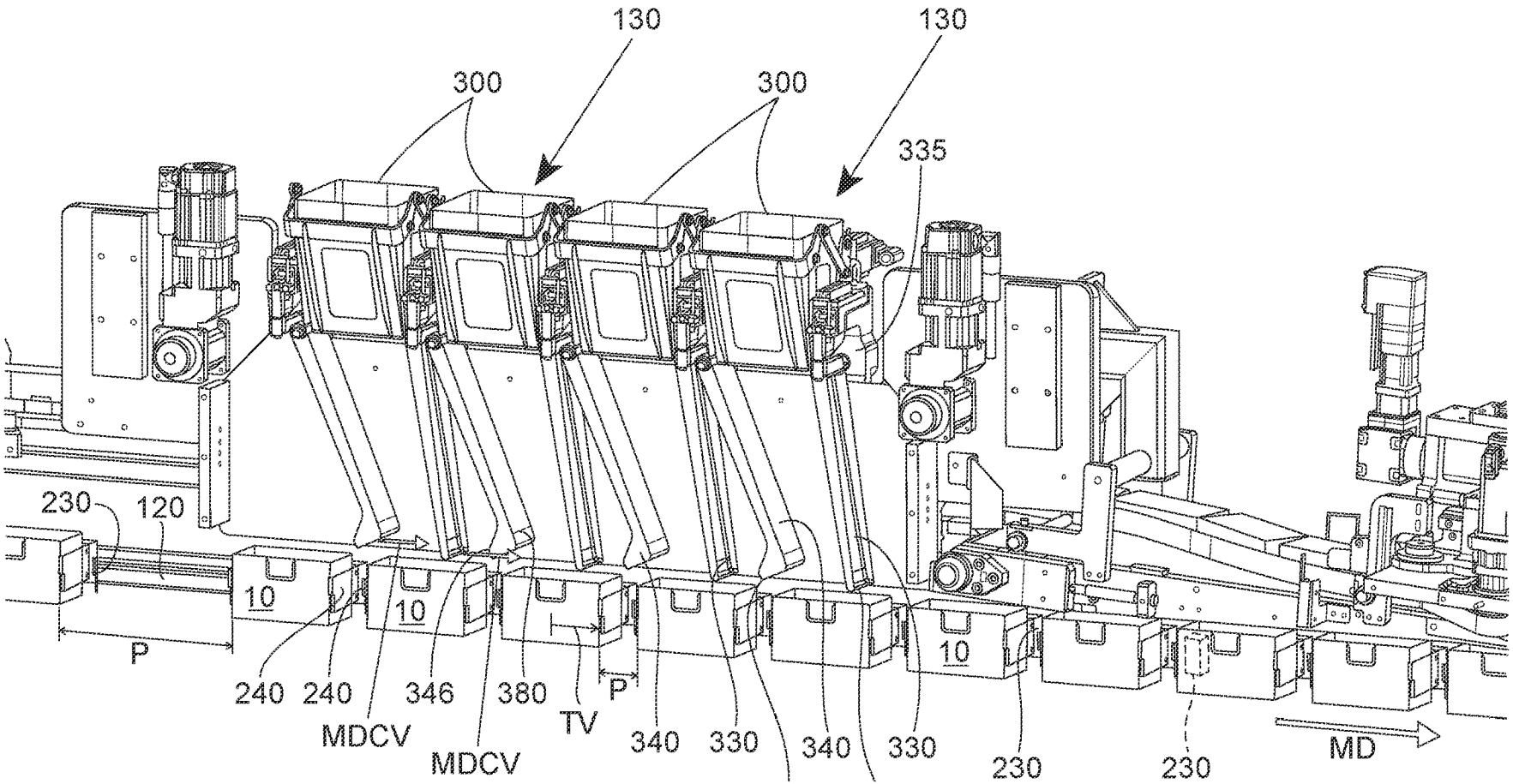
FIG. 8 is a side view of a plurality of dispensing systems arranged in series.

The downstream leg 330 can have a downstream leg width 360 measured orthogonal to the machine direction and the downstream leg width 360 can be at least about 80% of the tray width 370. The tray width 370 is measured between the interior facing surfaces of the front face and the back face 50. Likewise, the upstream leg 340 can have an upstream leg width 380 measured orthogonal the machine direction and the upstream leg width 380 can be at least about 80% of the tray width 370 (FIG. 8). By having a relatively wide downstream leg 330 and a relatively wide upstream leg 360, the wad of products 1 falling between the downstream leg 330 and the upstream leg 360 can remain under control and be guided into the tray 10.

The tray width 370 can be from about 60 mm to about 130 mm, optionally from about 80 mm to about 110 mm, optionally about 95 mm. The tray width 370 can be sized and dimensioned to be greppable by a consumer between his or her thumb and middle finger. The downstream leg width 360 and the upstream leg width 380 can be from about 60 mm to about 130 mm, optionally from about 80 mm to about 110 mm, optionally about 95 mm. The hopper 300, downstream leg 330 and upstream leg 340 can be centered above the tray 10 in the machine direction MD, which improves the likelihood that products 1 are transported into the tray 10 without any of the products 1 escaping control in the cross direction CD.

Motion of the tray 10 in the machine direction MD by the tray carriage system 120 can be controlled. The tray carriage system 120 can be a variable speed conveyor. For example, the trays 10 may be carried on a belt that can operate at different velocities in the machine direction MD. In such an arrangement, each tray 10 on the belt has the same tray velocity.

Optionally, each tray 10 may be conveyed individually by a tray carriage system 120 that comprises a plurality of linear motor vehicles 230. The tray carriage system 120 can be a horizontally oriented track system in which movement of individual linear motor vehicles 230 is controlled. A suitable linear motor track system can be an ITRAK system from Rockwell Automation. A tray 10 can be conveyed by adjacent linear motor vehicles 230. Each linear motor vehicle 230 can have a restraint plate 240 attached thereto. The restraint plate 240 can be oriented orthogonal to the machine direction MD. Each tray 10 can be held by restraint plates 240 of adjacent linear motor vehicles 230. In operation, adjacent pairs of linear motor vehicles 230 can be individually controlled or controlled in pairs to hold a tray 10 between the restraint plates 240 of adjacent linear motor vehicles 230. Each tray 10 can be held by pinching the tray in the machine direction MD by adjacent linear motor vehicles 230. The pitch P amongst trays 10 can be nonconstant and individually controlled. The position of individual trays 10 can be controlled to match up with the position of the hood 60 being fitted thereto and to match up with movement of the downstream leg 330 and upstream leg 340.

The downstream leg distal end 336 and the upstream leg distal end can be moved at an individual or common reference machine direction component velocity MDCV. The downstream leg 330 and upstream leg 340 can swing about the downstream leg pivot 337 and upstream leg pivot 348, respectively. In motion, each of the distal ends of the legs has a component velocity in the machine direction MD referred to as the machine direction component velocity MDCV. The machine direction component velocity MDCV of the downstream leg distal end 336 and the upstream distal end 346 can be the same as one another so that they have a common reference machine direction component velocity MDCV. Optionally, the machine direction component velocity MDCV of the downstream leg distal end 336 and the upstream distal end 346 can be individually controlled and differ from one another.

The tray 10 can be moved at the tray velocity TV via the tray carriage system 120 in the machine direction MD. The tray velocity TV can be altered in response to a reported or calculated position of one or both of the downstream leg distal end 336 and the upstream leg distal end 346. Varying the tray velocity TV can allow for a higher number of trays filled per unit of time. The tray carriage system 120 can be slowed down while a tray 10 is being filled and then once filled the tray 10 can be sped up. This can increase the overall through put of the dispensing system 130 even if all of the trays 10 carried by the tray carriage system 120 all have the same tray velocity TV. If the tray velocity TV of each tray 10 is independently controlled, as is possible if the tray carriage system 120 is based on linear motor vehicles 230, the overall through put of the dispensing system 130 can be higher than a dispensing system 130 in which trays 10 each have the same tray velocity TV while the tray 10 is carried by the tray carriage system 120.

The dispensing system 130 and the tray carriage system 120 can be synchronized so that the downstream distal end 336 of the downstream leg 330 tracks just upstream of the leading face and the upstream distal end 346 tracks just downstream of the trailing face 30 as the tray 10 passes beneath the dispensing system 130. The synchronization can be accomplished by the controller of the tray carriage system 120 referencing the position of one or both legs of the dispensing system 130, or the controller of dispensing system 130 referencing the position of the tray 10 in the tray carriage system 120, or control of the tray carriage system 120 and the dispensing system 130 can be coupled to one another based on the reference position of one or both legs and reference position of the tray 10 in the tray carriage system 120. In operation and while products 1 are being transported from the hopper 300 to the tray 10, maintaining the downstream distal end 336 just upstream of the of the leading face 20 and the upstream distal end 346 just downstream of the trailing face 30 can help reduce the probability that a product 1 will not be transported into the tray and provide for a wide funnel for the products 1 that has a high capacity.

A plurality of trays 10 can be provided in the tray carriage system 120. The plurality of trays 10 can be moving in series in the tray carriage system 120. The pitch P amongst the trays can be constant or nonconstant. For example, the tray carriage system 120 can be a belt upon which the trays 10 all move at the same velocity. The pitch P amongst adjacent trays 10 can differ from the pitch P amongst other adjacent trays 10. The controller or controllers for the dispensing system 130 and the tray carriage system 120 can receive inputs from a vision system or other device for detecting or computing the position of the trays 10 as they pass beneath the dispensing system 130. The tray carriage system 120 can alter the velocity of the tray 10 as the tray 10 approaches, passes beneath, and departs from the dispensing system. Likewise, the controller of the dispensing system 130 can control opening and closing of the hopper 300 and movement of the downstream leg 330 and upstream leg 340 so that the products 1 are transported into the tray 10. The control systems can employ vision systems that include a camera, an image acquisition system, and image analysis software, connected through a programmable logic controller. The vision system can be capable of measuring parts, verifying the position of parts, and recognizing the shape of parts. Based on inputs from the vision system, the control system can influence the process by altering the tray velocity TV, opening or closing the hopper 300 and control movement of the upstream leg 340 and downstream leg 330. Optionally, one or more photo eyes may be provided to detect the presence or lack of presence of parts of the hood and tray as well as the positions of elements of the filling equipment and the control system can receive such input and operate the dispensing system.

A tray 10 can approach the dispensing system 130 at a first tray velocity TV. The tray 10 can be decelerated as the tray 10 approaches passes beneath the hopper 300. Products 1 can be dispensed into the tray 10 while the tray is at a tray velocity TV that is comparatively less than the first tray velocity TV. While or after products 1 are dispensed into the tray 10, the tray 10 can be accelerated to a second tray velocity TV that is comparatively greater than the tray velocity TV at which the tray 10 passed beneath the hopper 300. As the tray 10 accelerates, the tray 10 can be transported further downstream in the machine direction MD.

The pitch P amongst trays 10 can be individually controlled. Such control can be provided by a tray carriage system 120 upon which or in which the trays 10 are carried by a linear motor vehicle 230 or carried between adjacent linear motor vehicles 230. The pitch P can be increased or decreased so as to maximize the number of trays 10 that can be filled per unit of time or otherwise optimize operation of the dispensing system 130. As tray 10 approaches the dispensing system 130, the velocity of the tray 10 may be increased or decreased to synchronize movement of the tray 10 beneath the dispensing system 130 with discharge of products 1 from the hopper 300 and movement of the downstream leg 330 and upstream leg 340. From a practical perspective, the velocity of trays 10 may be higher upstream and downstream of the dispensing system 130 and each of the trays 10 may slow down as the tray 10 approaches, passes beneath, and departs the dispensing system 130. Such an arrangement reduces the time that it takes for a tray 10 to traverse the portion of the production line or filling line dedicated to filling products 1 into trays 10.

The tray carriage system 120 can comprise a plurality of individually controlled linear motor vehicles 230. Each tray 10 can be carried by a single linear motor vehicle 230. The linear motor vehicles 230 can be provided with structure to firmly hold a tray 10 while the tray 10 is carried thereon. Optionally, trays 10 may be carried by adjacent linear motor vehicles 230 that pinch or otherwise hold the tray 10 between the adjacent linear motor vehicles 230. One approach for carrying trays 10 between adjacent linear motor vehicles 230 is to provide each linear motor vehicle with a restraint plate 240. The restraint plate 240 can be oriented orthogonal to the machine direction MD. Each tray 10 can be held by restraint plates 240 of adjacent linear motor vehicles 230. In operation, adjacent pairs of linear motor vehicles 230 can be individually controlled or controlled in pairs to hold a tray 10 between the restraint plates 240 of adjacent linear motor vehicles 230.

The control systems can employ vision systems that include a camera, an image acquisition system, and image analysis software connected through a programmable logic controller. The vision system can be capable of measuring parts, verifying the position of parts, and recognizing the shape of parts. Based on inputs from the vision system, the control system can influence the process by, for example, altering the tray velocity TV to match movement of components of the dispensing system 130. Optionally, one or more photo eyes may be provided to detect the presence or lack of presence of parts and the control system can receive such input and operate the hood engagement system on the basis of such input.

The process described herein can comprise a plurality of dispensing systems 130 as described above. Two, three, four, five, six, or more dispensing systems 130 may be arranged in series. A group of trays 10 may arrive at the dispensing systems 130 together and the dispensing systems 130 can each dispense products 1 into a tray 10 positioned beneath each respective dispensing system 130. The velocity profile of each of the trays 10 as well as the operation of each of the dispensing systems 130 can be individually controlled. Optionally, operation and control of a particular dispensing system 130 and the tray 10 associated therewith can be coupled with one another. Optionally, the plurality of dispensing systems 130 can be controlled as one unit. Providing a plurality of dispensing systems 130 in series can increase the number of trays that can be filled per unit of time compared to process in which only a single dispensing system 130 is present.

Optionally, each of the dispensing systems 130 can operate independently of the other dispensing systems 130. While one or more of the dispensing systems 130 is dispensing products 1 into a tray associated with the dispensing system 130, the hopper 300 of one or more other dispensing systems 130 that has already dispensed products 1 can be refilled and prepared to dispense products 1 to the next arriving tray 10. The control systems for the dispensing system 130 and the tray carriage system 120 can be coupled to one another so that the control systems instruct each tray 10 to travel to a dispensing system 130 that is ready to dispense products 1 into the tray 10 and then dispenses products 1 into the tray 10. While one or more dispensing systems 130 is dispensing products 1 into trays 10 associated therewith, the hopper 300 of one or more other dispensing systems 130 can be refilled with products. The next arriving tray 10 can be routed to a dispensing system 130 having a filled hopper 300 and the products 1 can be dispensed into that next arriving tray 10.

Figure 9:
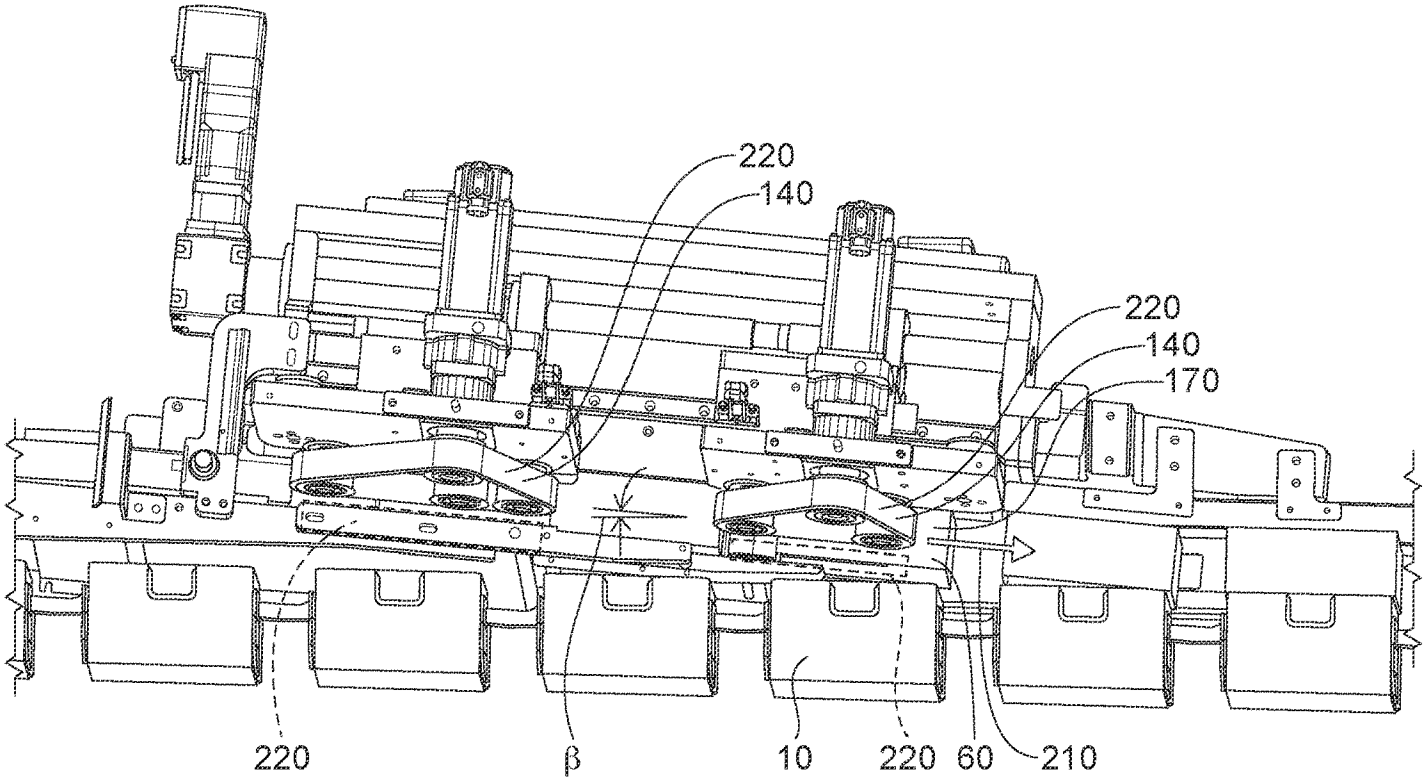
FIG. 9 is a hood engagement system for feeding hoods to be captured by a tray.

The hood engagement system 140 is the mechanism for positioning a hood 60 so that the hood 60 can be captured by a tray 10 as the tray 10 moves downstream in the machine direction MD. As shown in FIG. 9, the hood engagement system 140 can comprise a hood travel pathway 210 oriented towards and at an angle β to the carriage system 120. The hood travel pathway 210 can be disposed between two hood drivers 220. The hood drivers 220 can move the hood 60 by contacting the hood 60 on opposing sides. A hood driver 220 can be a belt. A hood driver can be a roller. Counter rotating hood drivers 220 can move the hood 60 by contacting the front panel 170 and opposing back panel to push or draw the hood 60 in the downstream direction. The tangential velocity of the hood drivers 220 can be individually controlled and controllable so that movement of the hood 60 can be synchronized with movement of the tray 10 so that the tray captures a hood 60 as the tray 10 moves in the downstream direction. Looking downstream in the machine direction MD, a hood drivers 220 can be present on the left and right sides.

Precise control of movement of the tray 10 can be provided by a carriage system 120 comprising a plurality of linear motor vehicles 230. The carriage system 120 can be a horizontally oriented track system in which movement of individual linear motor vehicles 230 is controlled. A suitable linear motor track system can be an ITRAK system from Rockwell Automation. A tray 10 can be conveyed by adjacent linear motor vehicles 230. Each linear motor vehicle 230 can have a restraint plate 240 attached thereto. The restraint plate 240 can be oriented orthogonal to the machine direction MD. Each tray 10 can be held by restraint plates 240 of adjacent linear motor vehicles 230. In operation, adjacent pairs of linear motor vehicles 230 can be individually controlled or controlled in pairs to hold a tray 10 between the restraint plates 240 of adjacent linear motor vehicles 230.

The pitch P amongst trays 10 can be nonconstant and individually controlled. The position of individual trays 10 can be controlled to match up with the position of the hood 60 being fitted thereto. Vision systems or sensors can detect the position and speed of the hood 60 and a computer system can adjust the velocity of the tray 10 so that the hood 60 is captured by a tray 10 as the tray 10 passes through the location at which the hood 60 merges with the tray 10.

The carriage system 120 can be configured to convey the trays 10 in a condition in which the tray 10 is squeezed in the longitudinal direction so that the front face 40 and back face 50 are outwardly bowed away from the longitudinal axis L. The outward bowing of the front face 40 and the back face 50 can arise during manufacture of the flat paperboard or corrugate. The amount of force applied in the machine direction MD and counter to the machine direction MD by the carriage system 120 can increase the amount of bowing as compared to the amount of bowing that might arise due to manufacture of the flat paperboard or corrugate and that which might arise as a result of transforming the flat paperboard or corrugate into a three-dimensional tray 10. Outwardly bowing the front face 40 and the back face 50, or having an outwardly bowed front face 40 and back face 50, can help provide for a tight fit between the hood 60 and the tray and a secure engagement of the locking mechanism. The tray 10 can be bowed, by way of non-limiting example, in a carriage system 120 that employs linear motor vehicles 230 by controlling or setting the spacing between adjacent linear motor vehicles 230. The spacing between adjacent linear motor vehicles 230 can be set to be less than the distance between the leading face 20 and trailing face 30, as measured between the outer surfaces, of the tray 10 in an unloaded condition. The software operating the adjacent linear motor vehicles 230 can be programmed to control the amount of bowing desired at different positions along the carriage system 120, which may vary as a function of position. The panels of the hood 60 aligned with the front face 40 and the back face 50 can also be bowed as a result of folding the substrate between the hood top 90 and the panels of the hood 60 aligned with the front face 40 and the back face 50. If corrugate is used to form the hood 60 and the fold lines are orthogonal to flutes, the panels of the hood 60 aligned with the front face 40 and the back face 50 can be outwardly bowed.

The hood 60 can be engaged with the tray 10 by progressively pinching the front face 40 and back face 50 towards one another along the longitudinal axis L as the hood 60 is engaged with the tray 10. This may tend to load the substrate constituting the front face 40 and rear face 50 in compression while the tray 10 is squeezed between adjacent linear motor vehicles 230 as the tray 10 is conveyed downstream in the machine direction MD.

The hood 60 can be sized and dimensioned to fit tightly with the tray 10 so that the tray may be securely closed. The hood can be engaged with the tray 10 by progressively pinching the front face 40 and the back face 50 towards one another along the longitudinal axis L as the hood 60 is engaged with tray 10 from the leading panel 70 to the trailing panel 80.

Once the tray 10 has captured the front panel 170, the hood 60 is at least partially fitted to the tray 10. As the tray 10 moves further downstream in the machine direction MD, the hood 60 can be further fitted to the tray 10 by providing a bumper that pushes the hood 60 onto the tray 10. The bumper can be configured to provide a reaction surface against which at least part of the hood 60 contacts. The distance between portions of the bumper and the carriage system 120 can decrease as a function of distance in the machine direction. The bumper can function as a wedge that pushes the hood 60 down onto the tray 10 as the tray 10 and hood 60 are conveyed in the machine direction downstream. The further fitting of the hood 60 to the tray 10 downstream of location at which the tray 10 first captures the hood 60 can occur while the tray 10 is held and under the control of the carriage system 120. As the tray 10 and hood 60 move in the machine direction, the hood 60 is telescopically fit to the tray 10. The bumper can have a smooth surface that engages with the hood 60 so that the hood slides easily along the bumper. The smooth surface of the bumper can be a polished steel or aluminum surface or a plastic material such as an acetal plastic or other plastic material having a low coefficient of friction and a smooth finish.

After the trailing panel 80 is fitted to the tray 10, the tray 10 and hood 60 engaged therewith can be handed off from the carriage system 120 to a downstream conveyor 260. A second bumper can be positioned above the downstream conveyor 260 to further telescopically fit the hood 60 to the tray 10. The second bumper can be wedge shaped or positioned to present a wedging surface to the hood 60 as the tray 10 and hood 60 are conveyed further downstream in the machine direction.

After the hood 60 is fitted to the tray 10 to form a closed package 110, the closed package 110 can be shipped from the location at which the closed package 110 is assembled. The closed package 110 can be shipped to a distribution center, customers, or consumers to finally reach the location at which the user opens the package 110 to use or consume the contents of the package 110.

Figure 10:
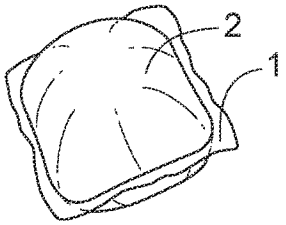
FIG. 10 is a water soluble unit dose article.

The substrate treatment composition 2 can be a water soluble unit dose article (FIG. 10). The article can be a pouch. From 1 to about 200, optionally from about 10 to 100, optionally from about 10 to about 40, water soluble unit dose articles 1 can be dispensed into each tray 10 as it passes beneath the dispensing system 130. Each tray 10 can be sized and dimensioned to contain the aforesaid number of water soluble unit dose articles. Each tray 10 can have an interior volume from about 500 mL to about 5000 mL, optionally from about 800 mL to about 4000 mL.

The water soluble article can be formed of a water soluble film that envelopes substances for treating surfaces. The substances can be a laundry detergent, dish detergent, or similar product. The water soluble film can be a polyvinyl alcohol film. The water soluble unit dose article can be a single compartment pouch or a multi-compartment pouch. The compartments may be side by side or one above the other. Each water soluble pouch can weigh from about 10 g to about 40 g, or optionally from about 15 g to 35 g.

Combinations

An example is below:

A. A process for packaging a product (1) comprising the steps of:
- manufacturing said product, wherein said product is a substrate treatment composition (2);
- providing a tray carriage system (120);
- providing a tray (10) movable in or on said tray carriage system, wherein said tray carriage system optionally comprises a plurality of linear motor vehicles (230);
- moving said tray via said tray carriage system in a machine direction (MD); providing a dispensing system (130) above said tray carriage system;
- dispensing said product into said tray via said dispensing system;
  - wherein said dispensing system comprises:
  - a product hopper (300) having a downstream end (310) and an upstream end (320), wherein said hopper has a closed position and an open position;
  - a downstream leg (330) having a downstream leg pivot portion (335) and a downstream leg distal end (336), wherein said downstream leg pivot portion is rotatable about a downstream leg pivot (337) nearer to said downstream end than said upstream end;
  - a downstream leg driver (339) engaged with said downstream leg;
  - an upstream leg (340) having an upstream leg pivot portion (345) and an upstream leg distal end (346), wherein said upstream leg pivot portion is rotatable about an upstream leg pivot (347) nearer to said upstream end than said downstream end;
  - an upstream leg driver (349) engaged with said upstream leg;
- providing a hood engagement system (140) above said tray carriage system and downstream of said dispensing system;
- providing a hood (60) moveable in said hood engagement system;
- engaging said hood with said tray via said hood engagement system to close said tray to form a closed package (110); and
- shipping said closed package.

B. The process according to Paragraph A, wherein said tray comprises a leading face (20) and a trailing face (30) upstream of said leading face, wherein said downstream leg distal end is moved in concert with said leading face and said upstream leg distal end is moved in concert with said trailing face while said product is transported from said hopper into said tray.

C. The process according to Paragraph A or B, wherein said tray comprises:
- a leading face (20) and a trailing face (30) upstream of said leading face; and
- a front face (40) and back face (50) opposite said front face, wherein said front face and said back face extend from said leading face to said trailing face in said machine direction;
- wherein said tray has a tray width (370) between said front face and said back face measured orthogonal to said machine direction; and
- wherein said downstream leg has a downstream leg width (360) measured orthogonal to said machine direction;
- wherein said upstream leg has an upstream leg width (370) measured orthogonal to said machine direction; and
- wherein said downstream leg width and said upstream leg width are at least about 80% of said tray width.

D. The process according to any of Paragraphs A to C wherein said hopper, said downstream leg, and said upstream leg are centered above said tray in said machine direction.

E. The process according to any of Paragraphs A to D, wherein said upstream leg distal end comprises a foot (348) oriented opposite said machine direction.

F. The process according to Paragraph E, wherein said tray comprises a leading face and a trailing face upstream of said leading face, wherein said tray has a tray length between said leading face and said trailing face, wherein said foot has a foot length (350) in said machine direction and said foot length is from about 5% to about 30% of said tray length.

G. The process according to any of Paragraphs A to F further comprising the steps of:
- moving said downstream leg distal end and said upstream leg distal end each at an individual or common reference machine direction component velocity (MDCV); and moving said tray at a tray velocity (TV) and altering said tray velocity in response to a reported or calculated position of one or both of said downstream leg distal end and said upstream leg distal end.

H. The process according to any of Paragraphs A to G, wherein said downstream leg driver and said upstream leg driver have separate motors.

I. The process according to any of Paragraphs A to H, wherein said process comprises providing a plurality of said dispensing systems in series in said machine direction.

J. The process according to any of Paragraphs A to I, wherein said substrate treatment composition is a water soluble unit dose article.

K. The process according to any of Paragraphs A to J, wherein a plurality of trays are provided in said tray carriage system at a pitch (P) between said trays, wherein said pitch between said trays is nonconstant and individually controlled.

L. The process according to any of Paragraphs A to K, wherein said tray carriage system comprises a plurality of linear motor vehicles (230), wherein a restraint plate (240) oriented orthogonal to said machine direction is attached to each linear motor vehicle, wherein each said tray is held by said restraint plates of adjacent linear motor vehicles.

M. The process according to any of Paragraphs A to L, wherein said tray carriage system comprises a plurality of individually controlled linear motor vehicles (230).

N. The process according to any of Paragraphs A to M, wherein said downstream leg distal end is upstream of said downstream leg pivot when said product hopper is opened to commence dispensing of said product from said product hopper to said tray.

O. The process according to any of Paragraphs A to N, wherein below said product hopper said downstream leg and said upstream leg funnel towards one another as said product is transported from said product hopper to said tray.

P. The process according to any of Paragraphs A to O, wherein said downstream leg 330 moves in reciprocating motion partially about said downstream leg pivot 337 and said upstream leg 340 moves in reciprocating motion partially about said upstream leg pivot 347 whereby together said downstream leg and said upstream leg guide said products into said tray as said tray travels beneath said dispensing system.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for packaging a product comprising the steps of:

manufacturing said product, wherein said product is a substrate treatment composition;

providing a tray carriage system;

providing a tray movable in or on said tray carriage system;

moving said tray via said tray carriage system in a machine direction;

providing a dispensing system above said tray carriage system;

dispensing said product into said tray via said dispensing system;

wherein said dispensing system comprises:

a product hopper having a downstream end and an upstream end, wherein said hopper has a closed position and an open position;

a downstream leg having a downstream leg pivot portion and a downstream leg distal end, wherein said downstream leg pivot portion is rotatable about a downstream leg pivot nearer to said downstream end than said upstream end;

a downstream leg driver engaged with said downstream leg;

an upstream leg having an upstream leg pivot portion and an upstream leg distal end, wherein said upstream leg pivot portion is rotatable about an upstream leg pivot nearer to said upstream end than said downstream end;

an upstream leg driver engaged with said upstream leg;

providing a hood engagement system above said tray carriage system and downstream of said dispensing system;

providing a hood moveable in said hood engagement system;

engaging said hood with said tray via said hood engagement system to close said tray to form a closed package; and shipping said closed package.

2. The process according to claim 1, wherein said tray comprises a leading face and a trailing face upstream of said leading face, wherein said downstream leg distal end is moved in concert with said leading face and said upstream leg distal end is moved in concert with said trailing face while said product is transported from said hopper into said tray.

3. The process according to claim 2, wherein said tray comprises:

a front face and back face opposite said front face, wherein said front face and said back face extend from said leading face to said trailing face in said machine direction;

wherein said tray has a tray width between said front face and said back face measured orthogonal to said machine direction; and wherein said downstream leg has a downstream leg width measured orthogonal to said machine direction;

wherein said upstream leg has an upstream leg width measured orthogonal to said machine direction; and wherein said downstream leg width and said upstream leg width are at least 80% of said tray width.

4. The process according to claim 1, wherein said hopper, said downstream leg, and said upstream leg are centered above said tray in said machine direction.

5. The process according to claim 1, wherein said upstream leg distal end comprises a foot oriented opposite said machine direction.

6. The process according to claim 5, wherein said tray comprises a leading face and a trailing face upstream of said leading face, wherein said tray has a tray length between said leading face and said trailing face, wherein said foot has a foot length in said machine direction and said foot length is from 5% to 30% of said tray length.

7. The process according to claim 1 further comprising the steps of:

moving said downstream leg distal end and said upstream leg distal end each at an individual or common reference machine direction component velocity; and moving said tray at a tray velocity and altering said tray velocity in response to a reported or calculated position of one or both of said downstream leg distal end and said upstream leg distal end.

8. The process according to claim 7, wherein a plurality of trays are provided in said tray carriage system at a pitch between said trays, wherein said pitch between said trays is nonconstant and individually controlled.

9. The process according to claim 8, wherein said tray carriage system comprises a plurality of individually controlled linear motor vehicles.

10. The process according to claim 9, wherein said downstream leg distal end is upstream of said downstream leg pivot when said product hopper is opened to commence dispensing of said product from said product hopper to said tray.

11. The process according to claim 10, wherein below said product hopper, said downstream leg and said upstream leg funnel towards one another as said product is transported from said product hopper to said tray.

12. The process according to claim 10, wherein said process comprises providing a plurality of said dispensing systems in series in said machine direction.

13. The process according to claim 1, wherein said downstream leg driver and said upstream leg driver have separate motors.

14. The process according to claim 1, wherein said process comprises providing a plurality of said dispensing systems in series in said machine direction.

15. The process according to claim 1, wherein said substrate treatment composition is a water soluble unit dose article.

16. The process according to claim 1, wherein a plurality of trays are provided in said tray carriage system at a pitch between said trays, wherein said pitch between said trays is nonconstant and individually controlled.

17. The process according to claim 1, wherein said tray carriage system comprises a plurality of linear motor vehicles, wherein a restraint plate oriented orthogonal to said machine direction is attached to each linear motor vehicle, wherein each said tray is held by said restraint plates of adjacent linear motor vehicles.

18. The process according to claim 1, wherein said tray carriage system comprises a plurality of individually controlled linear motor vehicles.

19. The process according to claim 1, wherein said downstream leg distal end is upstream of said downstream leg pivot when said product hopper is opened to commence dispensing of said product from said product hopper to said tray.

20. The process according to claim 1, wherein below said product hopper, said downstream leg and said upstream leg funnel towards one another as said product is transported from said product hopper to said tray.

* * * * *